US012352138B2

(12) United States Patent
Maddux et al.

(10) Patent No.: US 12,352,138 B2
(45) Date of Patent: Jul. 8, 2025

(54) EXPANSION TOOL WITH A HYBRID CONE FOR EXPANSION OF AN EXPANDABLE LINER HANGER IN A WELLBORE

(71) Applicant: Halliburton Energy Services, Inc., Houston, TX (US)

(72) Inventors: Stephen Ross Maddux, Singapore (SG); Shengjun Yin, Carrollton, TX (US); Chee Sing Kelvin Loh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/355,030

(22) Filed: Jul. 19, 2023

(65) Prior Publication Data

US 2025/0027387 A1 Jan. 23, 2025

(51) Int. Cl.
*E21B 43/10* (2006.01)

(52) U.S. Cl.
CPC ..... *E21B 43/105* (2013.01)

(58) Field of Classification Search
CPC ..... E21B 43/10; E21B 43/105
See application file for complete search history.

(56) References Cited

U.S. PATENT DOCUMENTS 3,203,451 A * 8/1965 Vincent ..... B29D 22/00 29/523
4,047,565 A * 9/1977 Crickmer ..... E21B 43/10 166/217
4,708,202 A * 11/1987 Sukup ..... E21B 33/1204 166/123
2003/0047320 A1* 3/2003 Badrak ..... E21B 43/103 166/207
2004/0168796 A1* 9/2004 Baugh ..... E21B 43/105 166/207
2004/0216891 A1* 11/2004 Maguire ..... E21B 43/106 166/207
2005/0056434 A1* 3/2005 Watson ..... E21B 43/105 166/207
2006/0052936 A1* 3/2006 Duggan ..... E21B 43/105 702/6
2006/0124295 A1 6/2006 Maguire
2008/0061510 A1 3/2008 Li et al.
2009/0200041 A1* 8/2009 Watson ..... E21B 43/105 166/208
2010/0326675 A1 12/2010 Doane et al.
2011/0000664 A1* 1/2011 Adam ..... E21B 43/105 166/207
2012/0085549 A1* 4/2012 O'Connor ..... E21B 43/105 166/380

(Continued)

OTHER PUBLICATIONS

"PCT Application No. PCT/US2023/070651, International Search Report and Written Opinion", Apr. 9, 2024, 9 pages.
"NL 2037700 Search Report", Nov. 25, 2024, 8 pages.

*Primary Examiner* — Yanick A Akaragwe
(74) *Attorney, Agent, or Firm* — DeLizio, Peacock, Lewin & Guerra, LLP

(57) ABSTRACT

A system comprising an expandable liner hanger to be positioned in a wellbore; and an expansion tool that includes hybrid cone that comprises a solid cone and a collapsible cone, wherein in response to the hybrid cone being driven downward, the expandable liner hanger is to expand.

19 Claims, 7 Drawing Sheets

(56) References Cited

U.S. PATENT DOCUMENTS

| | | | | |
|---|---|---|---|---|
| 2012/0222868 | A1* | 9/2012 | Hazelip | E21B 43/105<br>166/208 |
| 2013/0333873 | A1 | 12/2013 | Giroux et al. | |
| 2014/0054047 | A1 | 2/2014 | Zhou | |

* cited by examiner

EXPANSION TOOL WITH A HYBRID CONE FOR EXPANSION OF AN EXPANDABLE LINER HANGER IN A WELLBORE

BACKGROUND

In wellbore operations with increasing energy demand, more hydrocarbon subsurface formations involve high pressure and high temperature (HPHT) conditions. HPHT conditions may be defined as an operating condition that includes a pressure value equal to or greater than 15,000 pounds per square inch (psi) and/or to and operating condition that includes an operating temperature value equal to or greater than 350° Fahrenheit (° F.). HPHT conditions may pose significant challenges to the safe wellbore operations.

In such HPHT conditions, expandable liner hangers may be used to secure a liner within a previously set casing or liner string. These types of liner hangers are typically set by expanding the liner hangers radially outward into a gripping and sealing contact with the previous casing or liner string.

BRIEF DESCRIPTION OF THE DRAWINGS

Embodiments of the disclosure may be better understood by referencing the accompanying drawings.

DESCRIPTION

Figure 1:
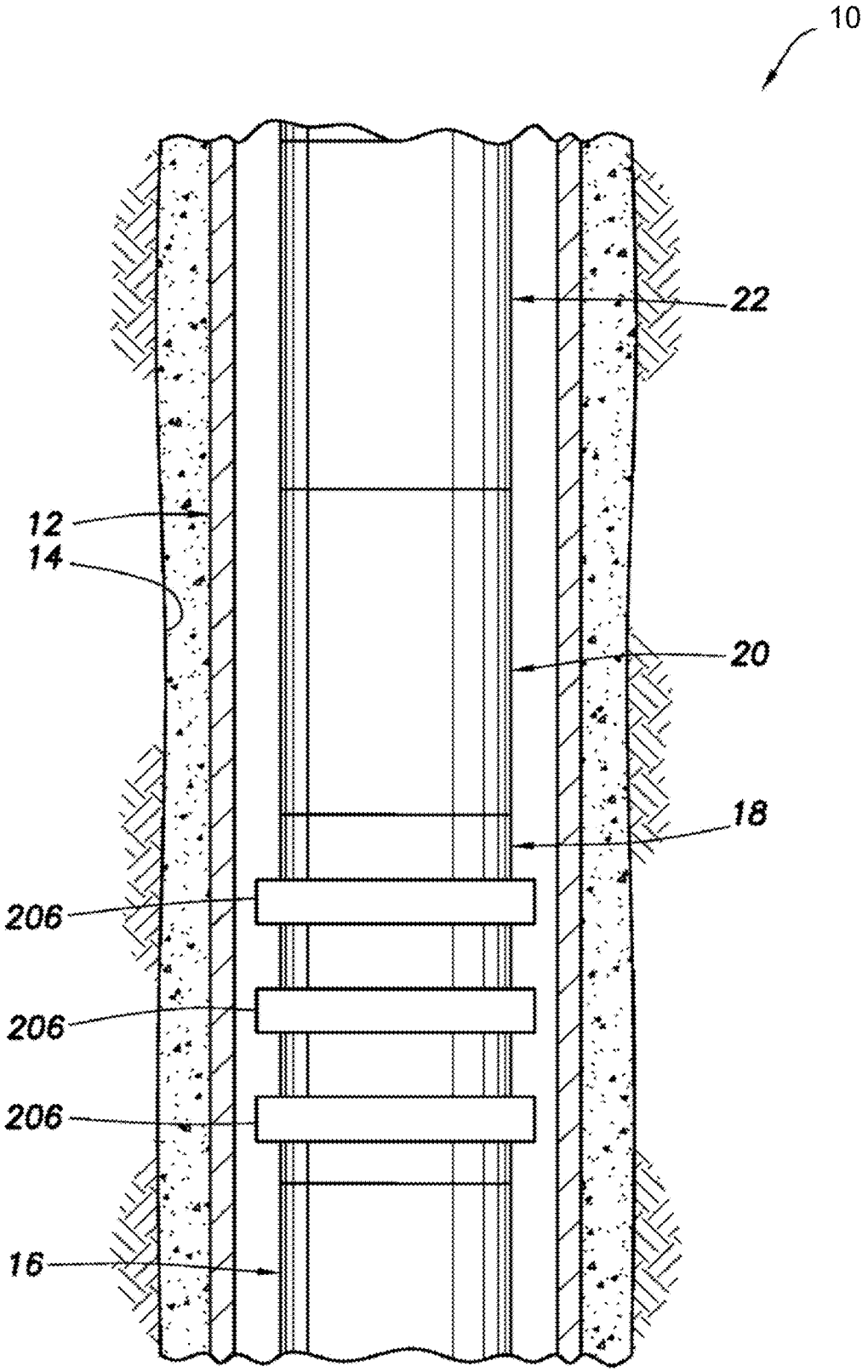
FIG. 1 is an elevation view in partial cross section of a well system having a hybrid cone expansion tool for securing an expandable liner hanger to a tubular in a wellbore, according to some embodiments.

The description that follows includes example systems, methods, techniques, and program flows that embody aspects of the disclosure. However, it is understood that this disclosure may be practiced without these specific details. For instance, this disclosure refers to detecting a feature in a pipe with pressure pulses. Aspects of this disclosure can also be applied to detecting more than one feature in one or more pipes with the pressure pulses. In other instances, well-known instruction instances, protocols, structures, and techniques have not been shown in detail in order not to obfuscate the description.

Example implementations relate to a running tool having a hybrid cone (that includes a solid cone and a collapsible cone) that is used to expand an expandable liner hanger against a tubular (e.g., casing) in a wellbore. A potential issue for an expandable liner hanger's application with a high yield parent casing may include the pullout force that is beyond the limitation of the running tool when a solid cone is used. The pullout force may be reduced when the traditional collapsible cone is used. However, use of such a cone may result in the collapsible cone and cone mandrel being significantly deformed. For example, an expandable liner hanger has been proposed for a high pressure wellbore application—which requires high yield casing (e.g. 170 thousand pounds per square inch (KSI) minimum yield) and a thick hanger body (e.g., thickness of 0.438 inches) due to a high pressure rating requirement. The significantly deformed cone mandrel in this type of application poses serious challenges to performance of the expandable liner hanger. In particular, the liner expandable hanger may contact mandrel and impede the expansion of the liner expandable hanger.

Some implementations may include an expansion tool that reduces pullout force while also minimizing the deformation on the cone and cone mandrel. Some implementations may include a new expansion configuration that includes a collapsible-solid hybrid cone. For example, example implementations may include a solid cone followed by a collapsible cone. In some embodiments, the collapsible cone may be held in position with a cone mandrel by a shear pin during expansion and sheared during pullout.

Accordingly and in contrast to conventional approaches, example implementations may use collapsible-solid hybrid cones in an expandable liner hanger. Such implementations may allow the expandable liner hanger to be more robust in HPHT applications (especially with high-yield and thick wall casing in high pressure conditions and allowing for use of wider ranges of sizes of the running tools).

Thus, some implementations may include a collapsible-solid hybrid cone system that includes a solid cone followed by a collapsible cone. The collapsible cone may be held in place with a cone mandrel by a shear pin during expansion and sheared during pullout. In some implementations, the collapsible cone may have a slightly larger outer diameter than the outer diameter of the solid cone.

In some implementations, the solid cone may expand the hanger first which may subsequently reduce the deformation on the collapsible cone and the cone mandrel during a second expansion. The collapsible cone may reduce the pullout force after the collapsible cone slides down the cone mandrel after shearing of the shear pin during pullout. Using such implementations may reduce the pullout force at least 50% as compared with conventional approaches using a solid cone. Additionally, the deformation on the collapsible cone and cone mandrel may be reduced, while the hanger's anchoring capacity may be minimally impacted.

In some implementations, more than one collapsible cone may be used. For example, the expandable liner hanger may include a dual collapsible cone configuration. In some implementations, the dual collapsible cones may have different outer diameters to expand hanger in stages and have smaller plastic strain on each collapsible cone and cone mandrel. Thus, example implementations may provide an expansion tool with a multi-cone configuration to provide sufficient force to secure or mechanically bond an expandable liner hanger having a thick body to a high yield casing or tubular (while still enabling the multi-cone configuration to survive the expansion and pullout operations.

Also, example implementations may provide an expansion tool that reduces the amount of force necessary to pullout the expansion tool because of the incorporation of the collapsible cone in the multi-cone configuration. Thus, the lead solid cone may first perform a large part of the expansion, followed by a collapsible cone to perform a smaller part of the expansion.

In some implementations, the expansion tool may comprise at least one hydraulic piston to create the necessary force to drive the solid cone and the collapsible cone at a same time. Based on the lower position, the solid cone may expand the expandable liner hanger first. Thus, example implementations may spread out the expansion force over more than one cone to reduce the amount of expansion force that a single cone will experience during the expansion.

Example System

FIG. 1 is an elevation view in partial cross section of a well system having a hybrid cone expansion tool for securing an expandable liner hanger to a tubular in a wellbore, according to some embodiments. In a liner hanger setting system 10 of FIG. 1, a tubular (such as a casing string) 12 has been installed and cemented within a wellbore 14. It is now desired to install a liner 16 extending outwardly from a lower end of the tubular 12, in order to further line the wellbore 14 at greater depths.

Note that, in this specification, the terms "tubular", "liner" and "casing" are used interchangeably to describe any type of tubular/tubular materials which are used to form protective linings in wellbores. Tubulars, liners and casings may be made from any material (such as metals, plastics, composites, etc.), may be expanded or unexpanded as part of an installation procedure, and may be segmented or continuous. It is not necessary for a tubular, liner or casing to be cemented in a wellbore.

As depicted in FIG. 1, an expandable liner hanger 18 is used to seal and secure an upper end of the liner 16 near a lower end of the tubular 12. Alternatively, the expandable liner hanger 18 may be used to seal and secure the upper end of the liner 16 above a window (not shown in FIG. 1) formed through a sidewall of the tubular 12, with the liner extending outwardly through the window into a branch or lateral wellbore. Thus, it will be appreciated that many different configurations and relative positions of the tubular 12 and liner 16 are possible.

An expansion tool 20 is connected between the expandable liner hanger 18 and a work string 22. The work string 22 may be used to convey the expansion tool 20, the expandable liner hanger 18 and the liner 16 into the wellbore 14, conduct fluid pressure and flow, transmit torque, tensile and compressive force, etc. The expansion tool 20 is used to facilitate conveyance and installation of the liner 16 and the expandable liner hanger 18, in part by using the torque, tensile and compressive forces, fluid pressure and flow, etc. delivered by the work string 22.

The system 10, methods, and particular elements thereof (such as the expansion tool 20, the expandable liner hanger 18, liner 16, etc.) are only examples of a wide variety of configurations, alternatives, etc. which may incorporate example embodiments. As further described below, the expansion tool 20 may include a hybrid cone configuration to cause the expandable liner hanger 18 to be secured to the tubular 12.

Example Hybrid Cone Expansion Tools for an Expandable Liner Hanger

Figure 2:
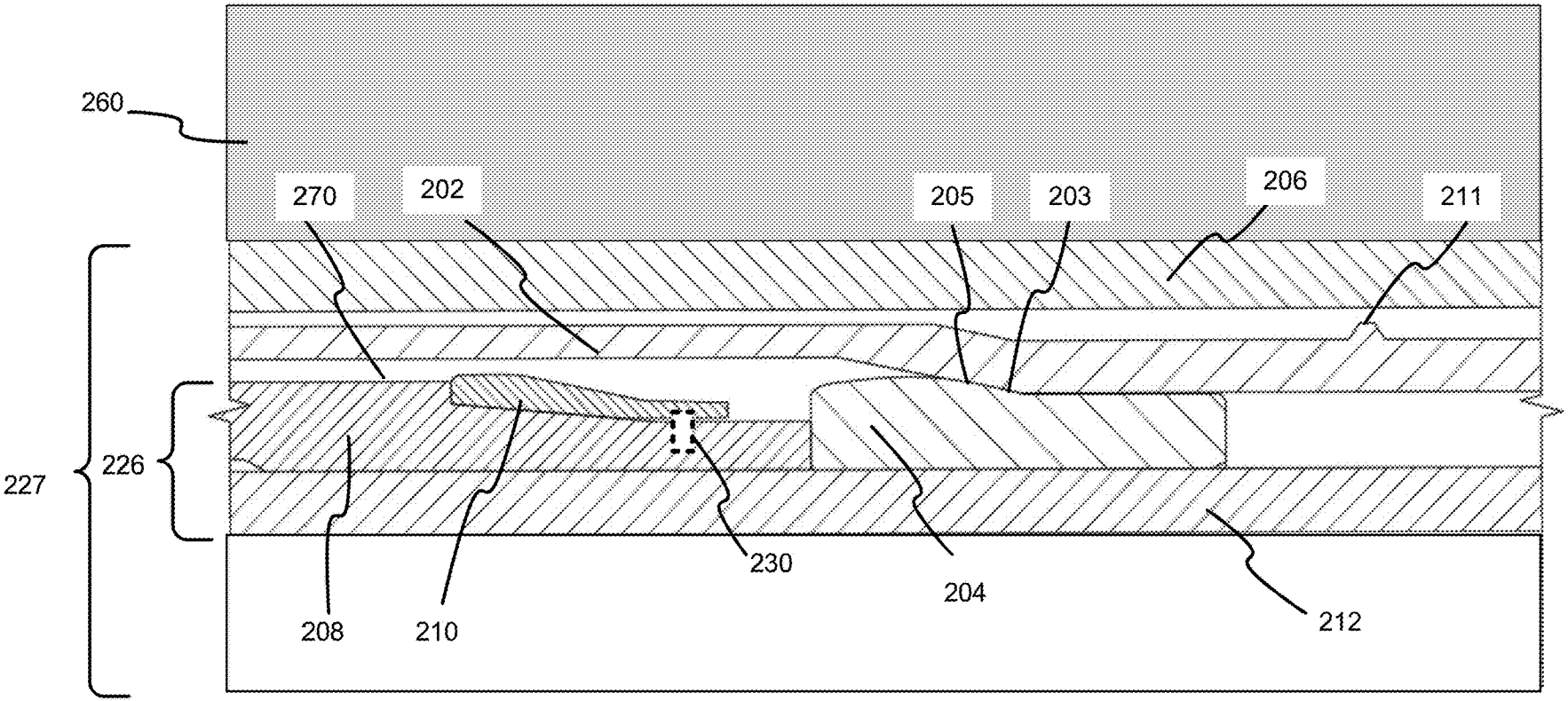
FIG. 2 is a cross sectional view of a first example expansion tool having a hybrid cone (that includes a solid cone and a collapsible cone) at a first time for securing an expandable liner hanger to a tubular in a wellbore, according to some embodiments.

Example hybrid cone expansion tools for securing an expandable liner hanger to a liner in a wellbore are now described. FIG. 2 is a cross sectional view of a first example expansion tool having a hybrid cone (that includes a solid cone and a collapsible cone) at a first time for securing an expandable liner hanger to a tubular in a wellbore, according to some embodiments. FIG. 2 depicts a wellbore 227 such that a surface and a bottom of the wellbore 227 (not shown) are on the left and right of the drawing, respectively.

In FIG. 2, a tubular 206 (such as a casing string) lines the wellbore 227 that is formed in a subsurface formation 260. As shown, an expandable liner hanger 202 has been positioned downhole in the wellbore 227. For example, the expandable liner hanger 202 may be positioned downhole using a work string to convey the expandable liner hanger 202 to a location where the expandable liner hanger 202 is to be secured or mechanically bonded to the tubular 206 via gripping elements 211. As shown, an expansion tool 226 has been positioned downhole in the wellbore 227. For example, the expansion tool 226 may be positioned downhole using a work string to convey the expansion tool 226 to a location relative to the expandable liner hanger 202 (as shown).

In particular, the expansion tool 226 includes a hybrid cone configuration that is used to expand the expandable liner hanger 202 outward to be secured to the tubular 206 via the gripping elements 211. The hybrid cone configuration includes a solid cone 204 and a collapsible cone 210. The solid cone 204 may be mounted on an expansion mandrel 212 of the expansion tool 226. The collapsible cone 210 may be mounted on a cone mandrel 208 of the expansion tool 226. In this example, the solid cone 204 is positioned below the collapsible cone 210 relative to a surface of the wellbore 227. In some implementations, an outer diameter of the collapsible cone 210 is larger than an outer diameter of the solid cone 204. The collapsible cone 210 may be held in position on the cone mandrel 208 by a shear pin 230 during expansion of the expandable liner hanger 202.

As shown, the expandable liner hanger 202 may include an angled portion 203, and the solid cone 204 may include an angled portion 205. In some implementations, the expansion tool 226 may be lowered into position relative to the expandable liner hanger 202 such that the angled portion 205 of the solid cone 204 is abutted up against the angled portion 203 of the expandable liner hanger 202.

In some implementations, a solid cone and a collapsible cone may be defined in terms of the amount of pullout force needed to release the cone from a secured position against the expandable liner hanger and upward toward the surface of the wellbore. For example, a solid cone may require at least 100,000 pounds of force for a release, whereas a collapsible cone may require much less (such as approximately 25,000-50,000 pounds of force). In some implementations, a collapsible cone may be a cone that requires less than 100,000 pounds of force for a release.

There is also a space 270 between the expansion tool 226 and an upper part of the expandable liner hanger 202 (above the collapsible cone 210 and the solid cone 204). A piston above (not shown) may drive a fluid through the space 270 of sufficient force to move the collapsible cone 210 and the solid cone 204 downward to expand the expandable liner hanger 202 outward.

Figure 3:
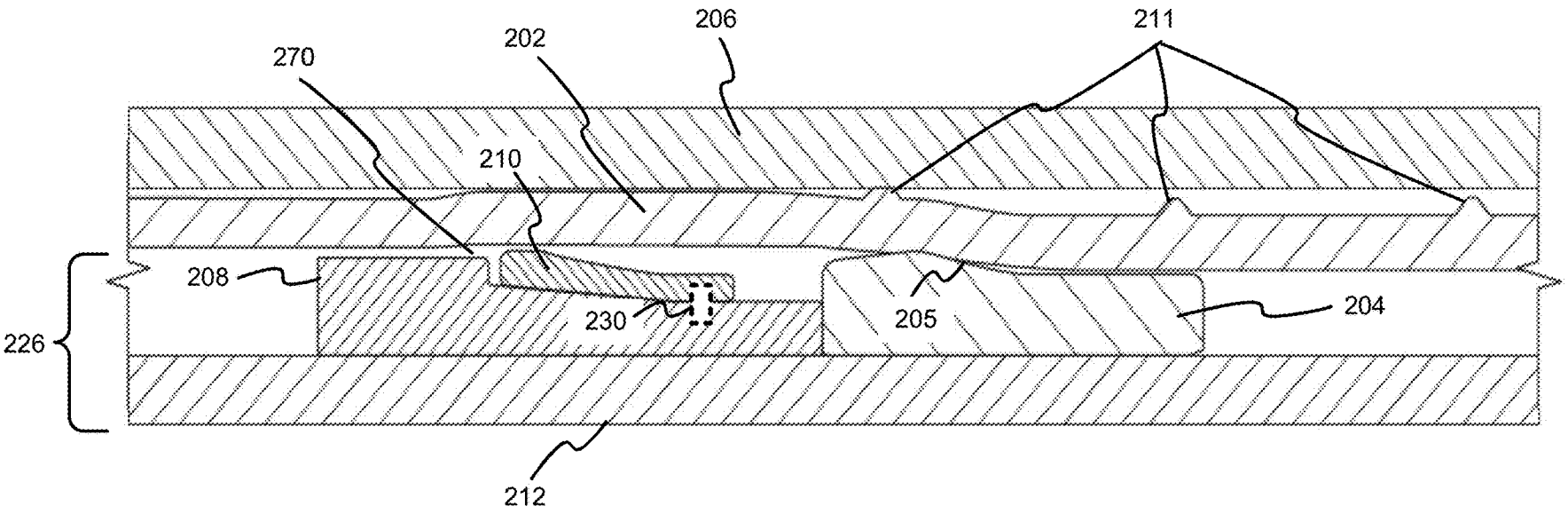
FIG. 3 is a cross sectional view of the first example expansion tool of FIG. 2 after a first expansion of the expandable liner hanger for securing an expandable liner hanger to the tubular in the wellbore, according to some embodiments.

To illustrate, FIG. 3 is a cross sectional view of the first example expansion tool of FIG. 2 after a first expansion of the expandable liner hanger for securing an expandable liner hanger to the tubular in the wellbore, according to some embodiments. As shown, the expansion tool 226 has been forced downward by the fluid being driven through the space 270 such that the solid cone 204 performs a first expansion of the expandable liner hanger 202 outward to secure the expandable liner hanger 202 to the tubular 206. As shown, at this point of the expansion the uppermost gripping element 211 has been secured to the tubular 206 because of the driving of the solid cone 204 downward.

Figure 4:
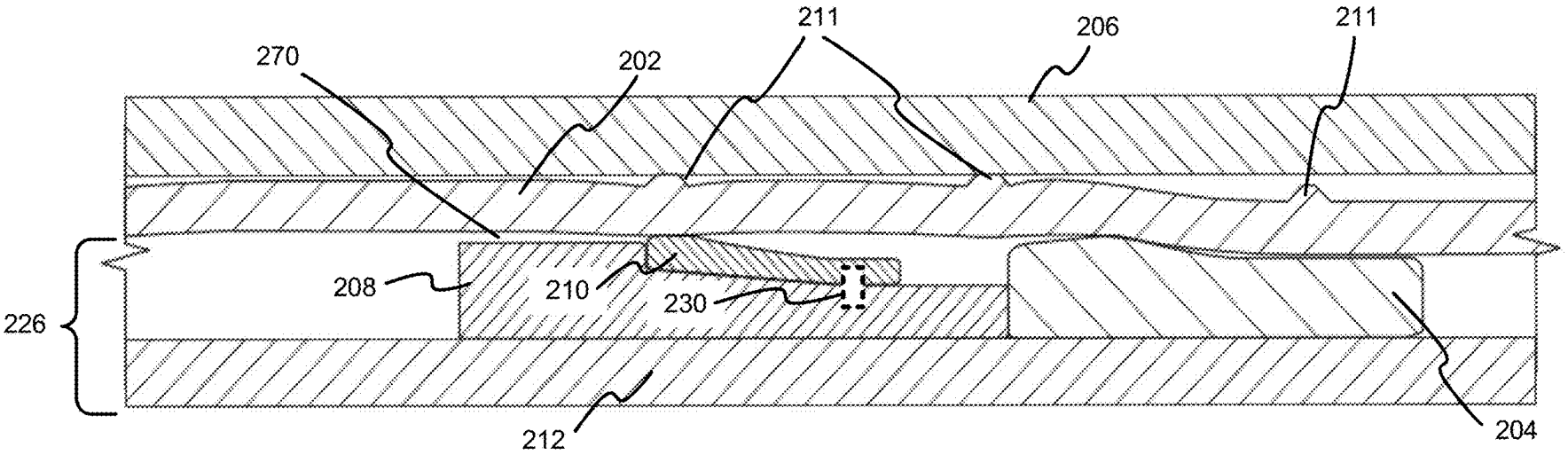
FIG. 4 is a cross sectional view of the first example expansion tool of FIGS. 2-3 after a second expansion of the expandable liner hanger for securing an expandable liner hanger to the tubular in the wellbore, according to some embodiments.

FIG. 4 is a cross sectional view of the first example expansion tool of FIGS. 2-3 after a second expansion of the expandable liner hanger for securing an expandable liner hanger to the tubular in the wellbore, according to some embodiments. As shown, the expansion tool 226 continues to be forced downward by the fluid being driven through the space 270 such that the collapsible cone 210 is next to cause further expansion of the expandable liner hanger 202 outward to secure the expandable liner hanger 202 to the tubular 206. As shown, at this point of the expansion the first and the second uppermost gripping elements 211 have been secured to the tubular 206 because of the driving of the collapsible cone 210 and the solid cone 204 downward.

Figure 5:
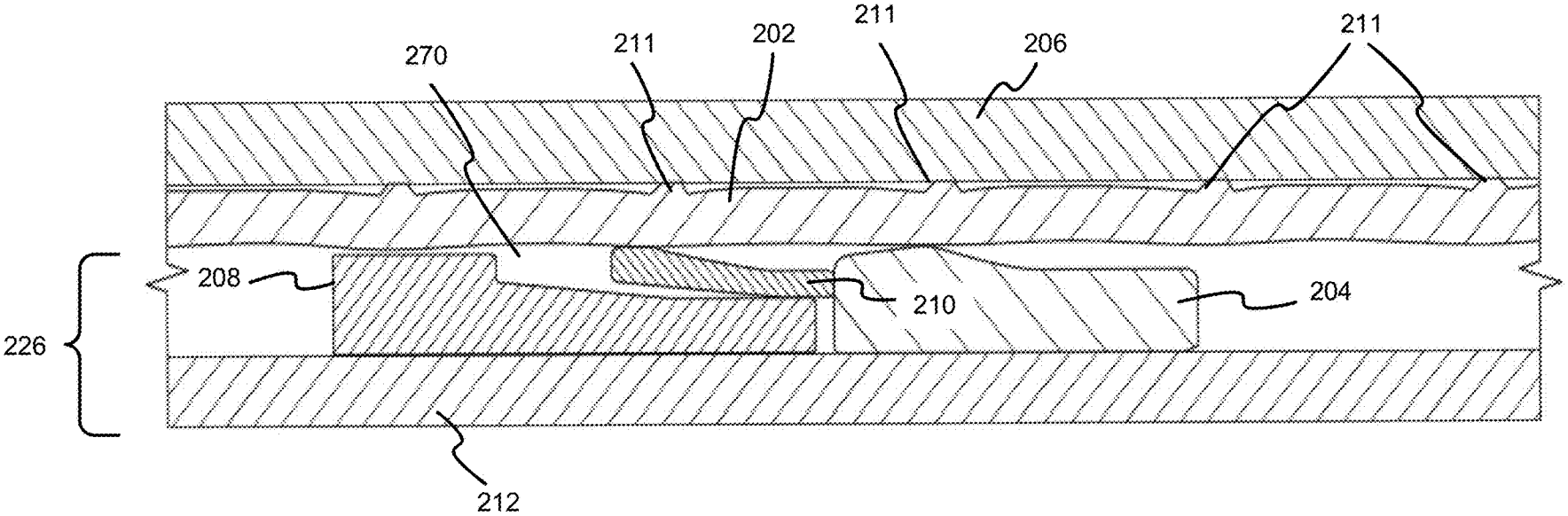
FIG. 5 is a cross sectional view of the first example expansion tool of FIGS. 2-4 during initial pullout of the expansion tool from the wellbore, according to some embodiments.

FIG. 5 is a cross sectional view of the first example expansion tool of FIGS. 2-4 during initial pullout of the expansion tool from the wellbore, according to some embodiments. As shown, the initial pullout force of the expansion tool 226 may cause the shear pin 230 to be sheared, thereby enabling the collapsible cone 210 to move downward (adjacent to the solid cone 204).

Figure 6:
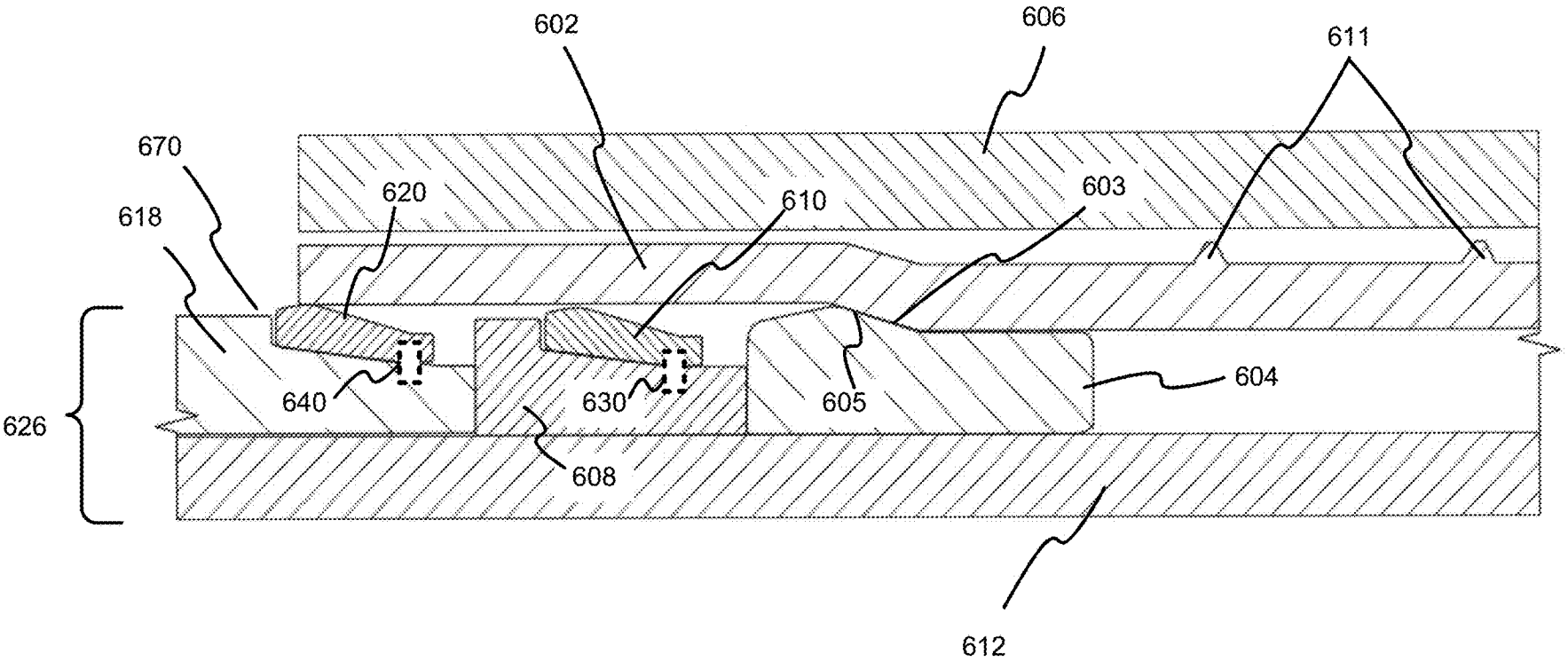
FIG. 6 is a cross sectional view of a second example expansion tool having a hybrid cone (that includes a solid cone and dual collapsible cones) for securing an expandable liner hanger to a casing in a wellbore, according to some embodiments.

FIG. 6 is a cross sectional view of a second example expansion tool having a hybrid cone (that includes a solid cone and dual collapsible cones) for securing an expandable liner hanger to a casing in a wellbore, according to some embodiments. The second example expansion tool of FIG. 6 is similar to the first example expansion tool of FIGS. 2-5 but includes dual collapsible cones. While depicted as having two collapsible cones, in some implementations, the expansion tool may have any number of collapsible cones (such as 3, 4, 5, etc.). In some implementations, the dual collapsible cones may have different outer diameters to expand the expandable liner hanger in stages and have smaller plastic strain on each collapsible cone and cone mandrel.

In FIG. 6, a tubular 606 (such as a casing string) lines the wellbore. As shown, an expandable liner hanger 602 has been positioned downhole in the wellbore. For example, the expandable liner hanger 602 may be positioned downhole using a work string to convey the expandable liner hanger 602 to a location where the expandable liner hanger 602 is to be secured or mechanically bonded to the tubular 606 via gripping elements 611. As shown, an expansion tool 626 has been positioned downhole in the wellbore. For example, the expansion tool 626 may be positioned downhole using a work string to convey the expansion tool 626 to a location relative to the expandable liner hanger 602 (as shown).

In particular, the expansion tool 626 includes a hybrid cone configuration that is used to expand the expandable liner hanger 602 outward to be secured to the tubular 606 via the gripping elements 611. The hybrid cone configuration includes a solid cone 604, a collapsible cone 610, and a collapsible cone 620. The solid cone 604 may be mounted on an expansion mandrel 612 of the expansion tool 626. The collapsible cone 610 may be mounted on a cone mandrel 608 of the expansion tool 626. The collapsible cone 620 may be mounted on a cone mandrel 618 of the expansion tool 626.

In this example, the solid cone 604 is positioned below the collapsible cone 610 relative to a surface of the wellbore. Also, the collapsible cone 610 is positioned below the collapsible cone 620 relative to a surface of the wellbore. In some implementations, an outer diameter of the collapsible cone 610 is larger than an outer diameter of the solid cone 604. Also, an outer diameter of the collapsible cone 620 may the same or larger than an outer diameter of the collapsible cone 610.

The collapsible cone 610 may be held in position on the cone mandrel 608 by a shear pin 630 during expansion of the expandable liner hanger 602. The collapsible cone 620 may be held in position on the cone mandrel 618 by a shear pin 640 during expansion of the expandable liner hanger 602.

As shown, the expandable liner hanger 602 may include an angled portion 603, and the solid cone 604 may include an angled portion 605. In some implementations, the expansion tool 626 may be lowered into position relative to the expandable liner hanger 602 such that the angled portion 605 of the solid cone 604 is abutted up against the angled portion 603 of the expandable liner hanger 602.

There is also a space 670 between the expansion tool 626 and an upper part of the expandable liner hanger 602 (above the collapsible cone 620, the collapsible cone 610, and the solid cone 204). A piston above (not shown) may drive a fluid through the space 670 of sufficient force to move the collapsible cone 620, the collapsible cone 610 and the solid cone 604 downward to expand the expandable liner hanger 602 outward.

Movement of the expansion tool 626 and expansion of the expandable liner hanger 602 may be similar to those described above with regard to the expansion tool 226 and the expandable liner hanger 202 of FIGS. 2-5 (but with the additional movement downward for a second collapsible cone for further expansion of the expandable liner hanger 602).

Accordingly, the expansion tool 626 may be forced downward by the fluid being driven through the space 670 such that the solid cone 604 performs a first expansion of the expandable liner hanger 602 outward to secure the expandable liner hanger 602 to the tubular 606.

The expansion tool 626 may continue to be forced downward by the fluid being driven through the space 670 such that the collapsible cone 610 is next to cause further expansion of the expandable liner hanger 602 outward to secure the expandable liner hanger 602 to the tubular 606. The expansion tool 626 may continue to be forced downward by the fluid being driven through the space 670 such that the collapsible cone 620 is next to cause further expansion of the expandable liner hanger 602 outward to secure the expandable liner hanger 602 to the tubular 606. The initial pullout force of the expansion tool 626 may cause the shear pin 630 and shear pin 640 to be sheared, thereby enabling the collapsible cone 610 and the collapsible cone 620, respectively to move downward (adjacent to the solid cone 604).

Example Operations

Figure 7:
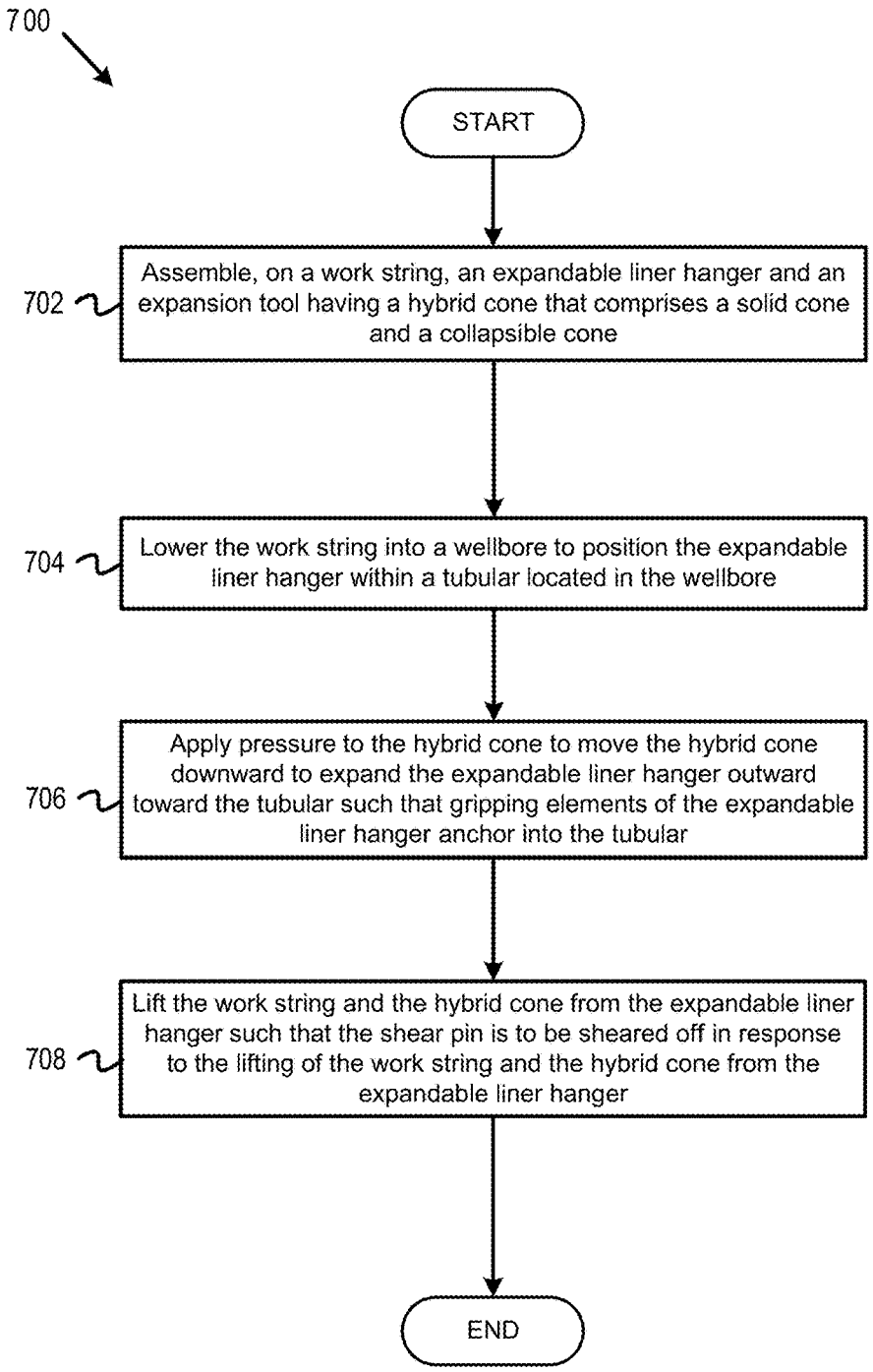
FIG. 7 is a flowchart of example operations for securing an expandable liner hanger to a tubular using a hybrid cone expansion tool, according to some embodiments.

Example operations are now described. FIG. 7 is a flowchart of example operations for securing an expandable liner hanger to a tubular using a hybrid cone expansion tool, according to some embodiments. Operations of a flowchart 700 of FIG. 7 can be performed by software, firmware, hardware, or a combination thereof. Operations of the flowchart 700 are described in reference to the example of the expansion tool and expandable liner hanger of FIGS. 1-5. However, other systems and components can be used to perform the operations now described. The operations of the flowchart 700 start at block 702.

At block 702, an expandable liner hanger and an expansion tool having a hybrid cone (that comprises a solid cone and at least one collapsible cone) are assembled on a work string. For example, with reference to FIG. 1, the expandable liner hanger 18 and the expansion tool 20 may be assembled on the work string 22.

At block 704, the work string is lowered into a wellbore to position the expandable liner hanger within a tubular located in the wellbore. For example, with reference to FIG. 2, the work string may be lowered into the wellbore 227 to position the expandable liner hanger 202 within the tubular 206 where the expandable liner hanger 202 is to be secured or mechanically bonded to the tubular 206.

At block 706, pressure is applied to the hybrid cone to move the hybrid cone downward to expand the expandable liner hanger outward toward the tubular such that gripping elements of the expandable liner hanger anchor into the tubular. For example, with reference to FIGS. 3-4, a piston above (not shown) may drive a fluid through the space 270 of sufficient force to move the collapsible cone 210 and the solid cone 204 downward to expand the expandable liner hanger 202 outward.

At block 708, the work string and the hybrid cone are lifted (or pulled out) from the expandable liner hanger such that the shear pin is to be sheared off in response to the lifting of the work string and the hybrid cone from the expandable liner hanger. For example, with reference to FIG. 5, the initial pullout force of the expansion tool 226 may cause the shear pin 230 to be sheared, thereby enabling the collapsible cone 210 to move downward (adjacent to the solid cone 204).

While the aspects of the disclosure are described with reference to various implementations and exploitations, it will be understood that these aspects are illustrative and that the scope of the claims is not limited to them. In general, techniques for seismic horizon mapping as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

Embodiment #1: A system comprising an expandable liner hanger to be positioned in a wellbore; and an expansion tool that includes hybrid cone that comprises a solid cone and a collapsible cone, wherein in response to the hybrid cone being driven downward, the expandable liner hanger is to expand.

Embodiment #2: The system of Embodiment #1, further comprising: a cone mandrel positioned on the expansion tool, wherein the collapsible cone is carried on the cone mandrel.

Embodiment #3: The system of Embodiment #2, wherein the collapsible cone is held in place on the cone mandrel by a shear pin while the expandable liner hanger expands in response to the hybrid cone moving downward.

Embodiment #4: The system of Embodiment #3, wherein the solid cone is to expand the expandable liner hanger prior to the collapsible cone expanding the expandable liner hanger.

Embodiment #5: The system of Embodiment #4, wherein the shear pin is to be sheared off during pull out of the expansion tool from the wellbore.

Embodiment #6: The system of Embodiment #5, wherein an outer diameter of the collapsible cone is greater than an outer diameter of the solid cone.

Embodiment #7: The system of Embodiment #6, wherein the hybrid cone comprises a different collapsible cone to create dual collapsible cone configuration.

Embodiment #8: The system of Embodiment #7, wherein the different collapsible cone is held in place on a different cone mandrel by a different shear pin while the expandable liner hanger expands in response to the hybrid cone moving downward.

Embodiment #9: The system of Embodiment #8, wherein an outer diameter of the different collapsible cone is different than the outer diameter of the collapsible cone and the outer diameter of the solid cone.

Embodiment #10: The system of Embodiment #9, wherein the hybrid cone is configured such that the solid cone is in contact with the expandable liner hanger prior to the different collapsible cone being in contact with the expandable liner hanger.

Embodiment #11: The system of Embodiment #10, wherein the hybrid cone is configured such that the different collapsible cone is in contact with the expandable liner hanger at a later time as compared to a time when the collapsible cone is in contact with the expandable liner hanger.

Embodiment #12: A method comprising: assembling, on a work string, an expandable liner hanger and an expansion tool having a hybrid cone that comprises a solid cone and a collapsible cone; lowering the work string into a wellbore to position the expandable liner hanger within a tubular located in the wellbore; and applying pressure to the hybrid cone to move the hybrid cone downward to expand the expandable liner hanger outward toward the tubular such that gripping elements of the expandable liner hanger anchor into the tubular.

Embodiment #13: The method of Embodiment #12, wherein applying pressure to the hybrid cone comprises applying pressure to the hybrid cone to move that hybrid cone downward such that the solid cone first comes into contact with the expandable liner hanger to expand the expandable liner hanger outward toward the tubular and the collapsible cone next comes into contact with the expandable liner hanger to further expand the expandable liner hanger outward toward the tubular such that the gripping elements of the expandable liner hanger anchor into the tubular.

Embodiment #14: The method of Embodiment #13, wherein the collapsible cone is held in place on a cone mandrel of the expansion tool by a shear pin while the expandable liner hanger expands in response to the hybrid cone moving downward.

Embodiment #15: The method of Embodiment #14, further comprising lifting the work string and the hybrid cone from the expandable liner hanger.

Embodiment #16: The method of Embodiment #15, wherein the shear pin is to be sheared off in response to the lifting of the work string and the hybrid cone from the expandable liner hanger.

Embodiment #17: The method of Embodiment #16, wherein the hybrid cone comprises a different collapsible cone, and wherein applying pressure to the hybrid cone comprises applying pressure to the hybrid cone to move that hybrid cone downward such that the collapsible cone comes into contact with the expandable liner hanger after the collapsible cone to further expand the expandable liner hanger outward toward the tubular such that the gripping elements of the expandable liner hanger anchor into the tubular.

Embodiment #18: The method of Embodiment #17, wherein the different collapsible cone is held in place on a different cone mandrel of the expansion tool by a different shear pin while the expandable liner hanger expands in response to the hybrid cone moving downward.

Embodiment #19: The method of any one of Embodiment #16-18, wherein the solid cone and the collapsible cone are positioned on the expansion tool such that the solid cone is lower in the wellbore than the collapsible cone as the expansion tool is lowered down the wellbore.

Embodiment #20: The method of Embodiment #19, wherein an outer diameter of the collapsible cone is greater than an outer diameter of the solid cone.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A system comprising:

an expandable liner hanger to be positioned in a wellbore; and an expansion tool that includes a hybrid cone that comprises a solid cone, and a collapsible cone with a shear pin disposed therein, wherein in response to the hybrid cone being driven downward, the solid cone is to expand the expandable liner hanger prior to the collapsible cone expanding the expandable liner hanger.

2. The system of claim 1, further comprising:

a cone mandrel positioned on the expansion tool, wherein the collapsible cone is carried on the cone mandrel.

3. The system of claim 2, wherein the collapsible cone is held in place on the cone mandrel by the shear pin while the expandable liner hanger expands in response to the hybrid cone moving downward.

4. The system of claim 1, wherein the shear pin is to be sheared off during pull out of the expansion tool from the wellbore.

5. The system of claim 1, wherein an outer diameter of the collapsible cone is greater than an outer diameter of the solid cone.

6. The system of claim 1, wherein the hybrid cone comprises a different collapsible cone to create a dual collapsible cone configuration.

7. The system of claim 6, wherein the different collapsible cone is held in place on a different cone mandrel by a different shear pin while the expandable liner hanger expands in response to the hybrid cone moving downward.

8. The system of claim 6, wherein an outer diameter of the different collapsible cone is different than the outer diameter of the collapsible cone and the outer diameter of the solid cone.

9. The system of claim 6, wherein the hybrid cone is configured such that the solid cone is in contact with the expandable liner hanger prior to the different collapsible cone being in contact with the expandable liner hanger.

10. The system of claim 6, wherein the hybrid cone is configured such that the different collapsible cone is in contact with the expandable liner hanger at a later time as compared to a time when the collapsible cone is in contact with the expandable liner hanger.

11. A method comprising:

assembling, on a work string, an expandable liner hanger and an expansion tool having a hybrid cone that comprises a solid cone, and a collapsible cone with a shear pin disposed therein;

lowering the work string into a wellbore to position the expandable liner hanger within a tubular located in the wellbore; and applying pressure to the hybrid cone to move the hybrid cone downward to expand the expandable liner hanger outward toward the tubular such that gripping elements of the expandable liner hanger anchor into the tubular, wherein the solid cone is to expand the expandable liner hanger prior to the collapsible cone expanding the expandable liner hanger.

12. The method of claim 11, wherein applying pressure to the hybrid cone comprises applying pressure to the hybrid cone to move the hybrid cone downward such that the solid cone first comes into contact with the expandable liner hanger to expand the expandable liner hanger outward toward the tubular and the collapsible cone next comes into contact with the expandable liner hanger to further expand the expandable liner hanger outward toward the tubular such that the gripping elements of the expandable liner hanger anchor into the tubular.

13. The method of claim 12, wherein the collapsible cone is held in place on a cone mandrel of the expansion tool by the shear pin while the expandable liner hanger expands in response to the hybrid cone moving downward.

14. The method of claim 13, further comprising lifting the work string and the hybrid cone from the expandable liner hanger.

15. The method of claim 14, wherein the shear pin is to be sheared off in response to the lifting of the work string and the hybrid cone from the expandable liner hanger.

16. The method of claim 15, wherein the solid cone and the collapsible cone are positioned on the expansion tool such that the solid cone is lower in the wellbore than the collapsible cone as the expansion tool is lowered down the wellbore.

17. The method of claim 16, wherein an outer diameter of the collapsible cone is greater than an outer diameter of the solid cone.

18. The method of claim 12, wherein the hybrid cone comprises a different collapsible cone, and wherein applying pressure to the hybrid cone comprises applying pressure to the hybrid cone to move the hybrid cone downward such that the different collapsible cone comes into contact with the expandable liner hanger after the collapsible cone to further expand the expandable liner hanger outward toward the tubular such that the gripping elements of the expandable liner hanger anchor into the tubular.

19. The method of claim 18, wherein the different collapsible cone is held in place on a different cone mandrel of the expansion tool by a different shear pin while the expandable liner hanger expands in response to the hybrid cone moving downward.

* * * * *